United States Patent [19]

Ishii

[11] 4,132,167

[45] Jan. 2, 1979

[54] FLUID SUPPLY APPARATUS FOR BLANKET CLEANING DEVICE IN OFFSET PRINTING MACHINE

[75] Inventor: Koji Ishii, Fuchu, Japan

[73] Assignee: Ryobi Ltd., Fuchu, Japan

[21] Appl. No.: 806,123

[22] Filed: Jun. 13, 1977

[30] Foreign Application Priority Data

Jun. 14, 1976 [JP] Japan ..... 51-70022

[51] Int. Cl.[2] ..... B41F 35/00

[52] U.S. Cl. ..... 101/425; 101/423; 137/625.22; 222/56

[58] Field of Search ..... 101/423, 424, 425, 363, 101/364, 350, 148; 118/209; 222/56, 108; 137/625.22

[56] References Cited

U.S. PATENT DOCUMENTS

| | | | |
|---|---|---|---|
| 1,579,537 | 4/1926 | Hughens | 137/625.22 X |
| 2,117,907 | 5/1938 | Ogdon | 137/625.22 X |
| 3,145,653 | 8/1964 | Lake | 101/364 |
| 3,171,436 | 3/1965 | Lowell | 137/625.22 X |
| 3,287,674 | 11/1966 | Stiegler | 137/625.22 X |
| 3,611,927 | 10/1971 | Johnson | 101/425 |
| 3,800,702 | 4/1974 | Roberts | 101/425 |
| 3,896,730 | 7/1975 | Garrett et al. | 101/425 |

*Primary Examiner*—Edward M. Coven

*Attorney, Agent, or Firm*—Sughrue, Rothwell, Mion, Zinn and Macpeak

[57] ABSTRACT

New blanket cleaning liquid flows from an inverted bottle 16 inserted through a hole 7 in the upper arm 8 of a U-shaped bracket 5 to a cleaning bath 2 via a spring biased push valve 20 in the bottle, a supply pool 9 in the lower arm of the bracket beneath the pouring mouth of the installed bottle, and a three-way control valve A. The latter may selectively communicate the supply pool with the cleaning bath in a delivery mode, or communicate the bath with a used liquid storage bottle 28 in a discharge mode. The bath is vertically disposed at a position proximate that of the bracket, whereby the liquid level in the bath is automatically maintained at the same level as the new cleaning liquid in the supply pool, which in turn is maintained at the height of the pouring mouth lip of the bottle 16.

8 Claims, 7 Drawing Figures

FLUID SUPPLY APPARATUS FOR BLANKET CLEANING DEVICE IN OFFSET PRINTING MACHINE

BACKGROUND OF THE INVENTION

This invention relates to a fluid supply apparatus for a blanket cleaning device in a rotary offset printing machine, and more particularly to a type thereof in which contaminated liquid in a cleaning bath can be readily replaced by new cleaning liquid.

Heretofore, new liquid has been poured into a blanket cleaning bath by directly lifting and tilting a container filled with the new cleaning liquid, and the contaminated cleaning liquid in the bath has been exchanged for new cleaning liquid by removing the cleaning liquid bath from the printing machine body.

In such a conventional device, however, it is difficult to maintain the level of the cleaning liquid in the bath constant at all times due to the evaporation of the liquid. Accordingly, new cleaning liquid must frequently be added to the bath to maintain the liquid level therein constant. This is troublesome at best, and such manual replenishment of the liquid supply is a dirty and disagreeable task for the machine operator.

SUMMARY OF THE INVENTION

Briefly, and according to the present invention, new blanket cleaning liquid flows from an inverted bottle inserted through a hole in the upper arm of a U-shaped bracket to a cleaning bath via a spring biased push valve in the bottle, a supply pool in the lower arm of the bracket beneath the pouring mouth of the installed bottle, and a three-way control valve. The latter may selectively communicate the supply pool with the cleaning bath in a delivery mode, or communicate the bath with a used liquid storage bottle in a discharge mode. The bath is vertically disposed at a position proximate that of the bracket, whereby the liquid level in the bath is automatically maintained at the same level as the new cleaning liquid in the supply pool, which in turn is maintained at the height of the pouring mouth lip of the inverted bottle.

BRIEF DESCRIPTION OF THE DRAWINGS

In the drawings;

FIG. 4 is a vertical sectional view showing the liquid discharge mode of the apparatus, and FIGS. 5 (A)–(C) show sectional views of the three-way liquid control valve, wherein

DETAILED DESCRIPTION OF THE PREFERRED EMBODIMENT

Figure 1:
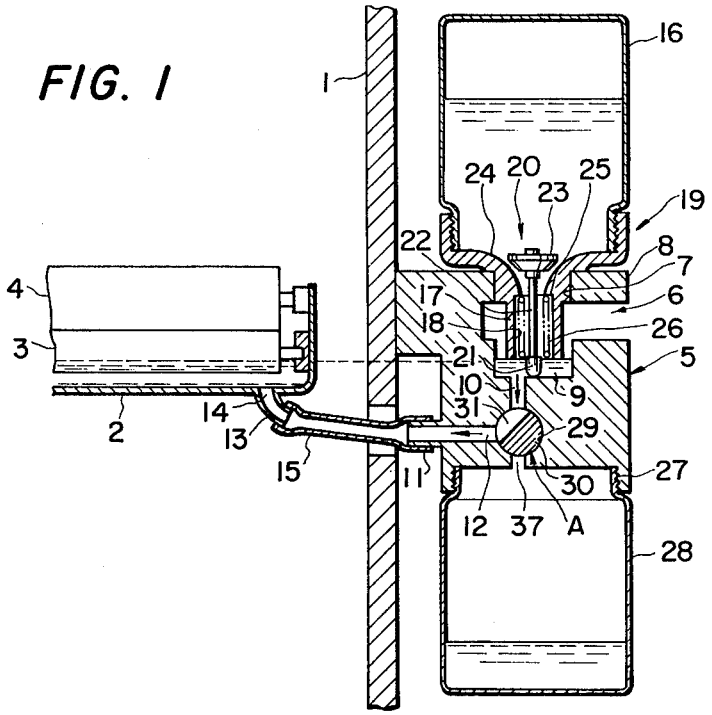
FIG. 1 is a vertical sectional view showing a liquid supply apparatus for a printing blanket cleaning device according to the present invention.
Figure 2:
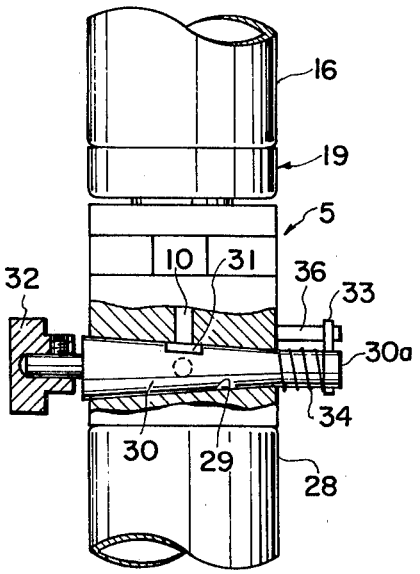
FIG. 2 is an end view of a portion of FIG. 1 partly in section.

Referring now to the drawings, a cleaning liquid bath 2 is disposed on the inside of a printing machine body frame 1, and rotatably mounts a take up roller 3 and a cleaning roller 4 in bearing means on the opposite ends of the bath. After printing, the ink on a rubber cylinder (not shown) is removed with the cleaning liquid in the bath by the rollers 3 and 4.

A bracket 5 is fixedly secured outside the frame 1 at a position opposite the bath 2. The bracket 5 is formed in a U-shape to define an outwardly opening recess 6, and includes an upper receiving stand 8 having a circular hole 7 therein above the recess and a liquid pool 9 disposed below the recess underneath the hole. The pool 9 communicates with the cleaning liquid bath 2 through a delivery passage 10 extending vertically downward from the bottom wall of the pool, a horizontal passage 12 in the side wall of the bracket 5 projecting outwardly in the form of a short pipe 11, and a hose 15 connected to the pipe 11 on one end and to a pipe elbow 13 joined to a liquid opening 14 in the bath on the other end.

The delivery passage 10 forms a right angle with the horizontal passage 12, and at their intersection a liquid discharge passage 37 communicates downwardly with the lower end of the bracket 5.

The mouth of a bottle 16 supported on the stand 8 is threadingly engaged with a closing cap 19 having a cylindrical portion 17 defining a pouring spout 18. The spout is closed by a valve 20 which comprises a stem 22, and actuating head 21, and a circular mushroom section 23. The mushroom section engages a valve seat 24 on the internal periphery of the pouring spout 18 under the urging of a compression spring 26 surrounding the stem 22, the respective ends of the spring bearing against the actuating head 21 and a shoulder 25 in the inner wall of the cylindrical portion 17. When the valve 20 is closed the actuating head protrudes from the cylindrical portion; the valve is moved inwardly by depressing the actuating head to thereby open the pouring spout. As shown in FIG. 1, the bottle 16 is installed upside down on the receiving stand 8 by inserting the cylindrical portion of the cap 19 into the circular hole 7. When the actuating head 21 abuts against the bottom wall of the pool 9 the valve 20 is pushed upward against the force of the spring 26 by the weight of the bottle and the cleaning liquid therein, as a result of which the mushroom section 23 moves away from its seat 24 to open the pouring spout 18 whereby new cleaning liquid flows out of the bottle and into the pool 9 until its level reaches the lip of the spout.

The bracket 5 has a threaded hole 27 in its bottom arm into which a transparent discharge liquid receiving bottle 28 is threadingly engaged such that the bottle communicates with the discharge passage 37.

A tapered bore 29 passes through the intersection of the delivery, horizontal, and discharge passages, and receives a similarly tapered control valve rod 30 in a liquid tight, rotatable manner. The valve rod has a semicircular cutout section 31 confronting the intersection of the three liquid passages to thus form a three-way control valve A in cooperation with the bore 29. This valve, as shown in FIGS. 5 (A), (B) and (C), is designed to selectively communicate the liquid delivery passage 10 with the horizontal passage 12, and the latter with the liquid discharge passage 37, but not to communicate the delivery passage with the discharge passage.

Figure 3:
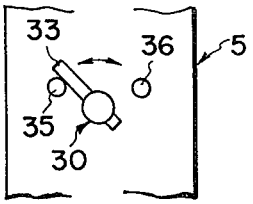
FIG. 3 is a rear view showing the liquid control valve stop structure.

A control knob 32 is provided at the larger diameter end of the rod 30, and a stop pin 33 is provided at the smaller diameter end perpendicular to the rod axis. The small diameter end protrudes through the side wall of the bracket to form an extension 30*a*, and a compression spring 34 is fitted therearound between the stop pin and the side wall of the bracket to apply a force to the extension and sealingly retain the valve rod in the bore 29. Stop posts 35 and 36 for the stop pin 33 are provided on the side wall of the bracket, as shown in FIG. 3.

Figure 5:
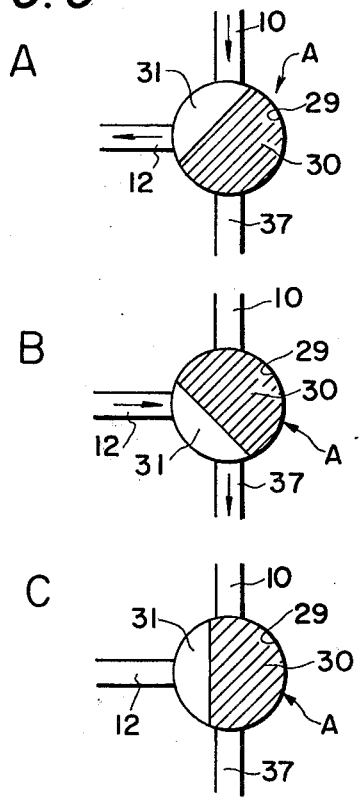
FIG. 5(A) illustrates the cleaning liquid delivery position, 5(B) illustrates the cleaning liquid discharge position, and 5(C) illustrates the neutral or blocking position of the valve.

The posts 35 and 36 are positioned such that the control valve rod 30 may be rotated to the positions shown in FIGS. 5 (A) and (B) whereat the stop pin 33 abuts one of the posts, or may be set at a middle position as shown in FIG. 5(C) whereat the three passages 10, 12 and 37 are interrupted.

In operation, when the cleaning liquid is initially supplied or added to the bath 2, the valve 20 is opened by installing the new cleaning liquid bottle 16 upside down, as shown in FIG. 1. As a result, the cleaning liquid pours into the pool 9 and flows therefrom into the delivery passage 10. If the valve A is set as shown in FIG. 5(A), the cleaning liquid flows through the horizontal passage 12 and the hose 15 into the bath.

The level of the cleaning liquid in the bath 2 is automatically maintained flush with the liquid surface in the pool 9, or with the lip of the bottle pouring spout 18, by simple pressure balance.

As the ink on the rubber cylinder is removed by the take-up roller 3 and the cleaning roller 4, the cleaning liquid gradually becomes dirty and contaminated.

Figure 4:
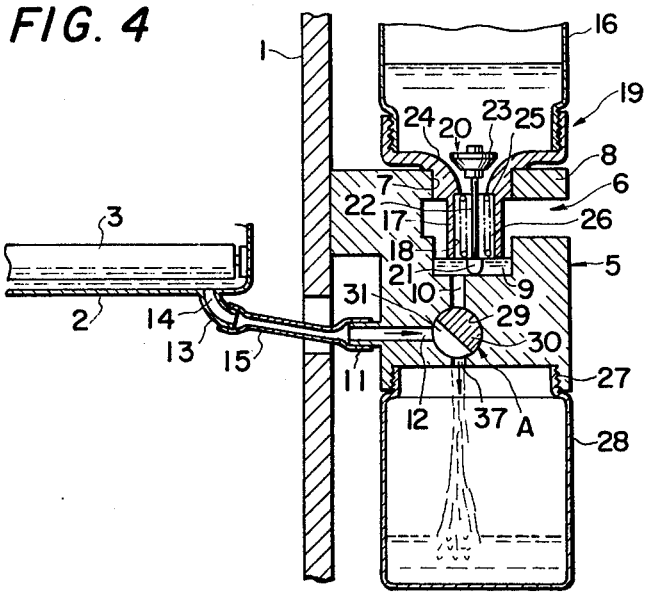

To discharge the contaminated liquid the valve A is switched to the FIG. 5(B) position whereat the stop pin 33 abuts the post 36, which blocks the delivery passage 10 and communicates the horizontal passage 12 with the discharge passage 37, as shown in FIG. 4. Thus, the supply of new cleaning liquid to the bath 2 is suspended, and instead the contaminated liquid in the bath is discharged into the receiving bottle 28 through the hose 15 and the passages 12, 37. When the discharge operation is completed the receiving bottle 28 is removed from the bracket 5 to dispose of the contaminated cleaning liquid.

What is claimed is:

1. A fluid supply apparatus for a blanket cleaning device in a rotary offset printing machine which includes a cleaning liquid bath having roller means for cleaning the blanket, and a passage for communicating cleaning liquid to and from the bath, comprising:

(a) a u-shaped mounting bracket fixedly secured on its side to a frame of the main body of the printing machine at a vertical position proximate that of the cleaning liquid bath, said mounting bracket having an upper arm and a lower arm;

(b) a new cleaning liquid container mounted in a circular aperture in the upper arm of the mounting bracket for supplying cleaning liquid to the bath;

(c) a liquid pool at the upper portion of the lower arm beneath the aperture and open to the atmosphere;

(d) a liquid delivery passage extending vertically downward from the pool;

(e) a horizontal passage communicating with the cleaning liquid bath through a coupling conduit and intersecting the delivery passage;

(f) a contaminated cleaning liquid reservoir mounted to the lower arm of the mounting bracket;

(g) a discharge passage extending vertically downward from the intersection of the horizontal and delivery passages and communicating with the contaminated cleaning liquid reservoir; and, (h) a control valve disposed at the intersection of the delivery, horizontal, and discharge passages for selectively communicating the delivery and horizontal passages or the horizontal and discharge passages.

2. A fluid supply apparatus as defined in claim 1, wherein the control valve comprises;

(a) a tapered bore in the lower arm of the bracket, (b) a similarly tapered valve rod rotatably inserted in the bore and having a semi-circular notch therein disposed at the intersection of the delivery, horizontal, and discharge passages, the ends of the rod projecting from the side walls of the bracket, (c) a control knob mounted on the larger diameter end of the valve rod, (d) a stop pin extending transversely from the smaller diameter end of the valve rod, (e) a compression spring interposed between the stop pin and the side wall of the bracket, and (f) a pair of spaced stop posts extending out from the side wall of the bracket to engage the stop pin and arrest the rotation of the valve rod at the positions where the delivery and horizontal passages are communicated and where the horizontal and discharge passages are communicated.

3. A fluid supply apparatus as defined in claim 2 wherein the new cleaning liquid container comprises;

(a) a bottle adapted to be installed upside down in the circular aperture, (b) a cap threadingly engaged with the opening of the bottle, the outer peripheral surface of the cap being seatingly engageable in the aperture, (c) a valve member having a seat on one end adapted to sealingly engage the inner periphery of the cap and an actuating head on the other end adapted to be displacingly engaged by the bottom of the liquid pool, and (d) a compression spring for biasing the valve member into a closed position.

4. A fluid supply apparatus as defined in claim 3, wherein the cleaning liquid bath is vertically disposed at a position such that the desired cleaning liquid level therein is at the same level as the mouth of the new cleaning liquid container in the liquid pool when the container is installed in the circular aperture, whereby the cleaning liquid in the bath is automatically maintained at the desired level.

5. A fluid supply apparatus as defined in claim 2, wherein the cleaning liquid bath is vertically disposed at a position such that the desired cleaning liquid level therein is at the same level as the mouth of the new cleaning liquid container in the liquid pool when the container is installed in the circular aperture, whereby the cleaning liquid in the bath is automatically maintained at the desired level.

6. A fluid supply apparatus as defined in claim 1 wherein the new cleaning liquid container comprises;

(a) a bottle adapted to be installed upside down in the circular aperture, (b) a cap threadingly engaged with the opening of the bottle, the outer peripheral surface of the cap being seatingly engageable in the aperture, (c) a valve member having a seat on one end adapted to sealingly engage the inner periphery of the cap and an actuating head on the other end adapted to be displacingly engaged by the bottom of the liquid pool, and (c) a compression spring for biasing the valve member into a closed position.

7. A fluid supply apparatus as defined in claim 6, wherein the cleaning liquid bath is vertically disposed at a position such that the desired cleaning liquid level therein is at the same level as the mouth of the new cleaning liquid container in the liquid pool when the container is installed in the circular aperture, whereby the cleaning liquid in the bath is automatically maintained at the desired level.

8. A fluid supply apparatus as defined in claim 1, wherein the cleaning liquid bath is vertically disposed at a position such that the desired cleaning liquid level therein is at the same level as the mouth of the new cleaning liquid container in the liquid pool when the container is installed in the circular aperture, whereby the cleaning liquid in the bath is automatically maintained at the desired level.

* * * * *